United States Patent [19]

Van Eek et al.

[11] 3,961,824

[45] June 8, 1976

[54] METHOD AND SYSTEM FOR WINNING MINERALS

[76] Inventors: Wouter Hugo Van Eek, 56, Groot Haesebroekseweg, Wassenaar; Henri Marie Boers, 71, Catsheuvel, The Hague; Arnold Willem J. Grupping, 3, Anjelierenlaan, Aerdenhout; Pieter Jacobus J. Van Wamelen, Delft; Willem Christian Rehm, 172 Gravenweg, Rotterdam, all of Netherlands

[22] Filed: Oct. 21, 1974

[21] Appl. No.: 516,615

[52] U.S. Cl. ..... 299/17; 175/263; 299/18; 299/20; 299/37; 299/80

[51] Int. Cl.[2] ..... E21B 9/26

[58] Field of Search ..... 299/19, 17, 18, 37, 299/80, 10, 34; 175/272, 259, 265, 285, 263; 166/174, 170; 15/104, 19

[56] References Cited

UNITED STATES PATENTS

| | | | |
|---|---|---|---|
| 1,257,561 | 2/1918 | Weber | 175/285 X |
| 2,434,239 | 1/1948 | Zublin | 166/50 X |
| 2,720,390 | 10/1955 | Brooks | 299/37 X |
| 3,070,361 | 12/1962 | Pew | 299/37 |
| 3,329,207 | 7/1967 | Shock et al. | 299/4 X |
| 3,776,594 | 12/1973 | Haspert | 299/37 X |

FOREIGN PATENTS OR APPLICATIONS

| | | | |
|---|---|---|---|
| 720,433 | 4/1942 | Germany | 175/272 |
| 1,212,900 | 3/1966 | Germany | 175/285 |
| 1,213,369 | 3/1966 | Germany | 175/285 |

*Primary Examiner*—Ernest R. Purser
*Assistant Examiner*—William F. Pate, III
*Attorney, Agent, or Firm*—Hammond & Littell

[57] ABSTRACT

A sectional scraper device which is foldable in zig-zag position by remote pulling means and which can be let down through a clad bore hole and can be deviated to follow layers of mineral to be mined by a to and fro movement of the scraper device combined with transport of loosened minerals by liquid circulation through the bore hole. The scraping action may be strengthened by the action of liquid jets emanating from the scraper device.

12 Claims, 5 Drawing Figures

METHOD AND SYSTEM FOR WINNING MINERALS

BACKGROUND OF THE INVENTION

The invention relates to a method for mining minerals such as coal with the aid of a scraping device that can be moved to and fro..

It is known that the minerals, such as coal, which cannot be exploited in open cast mining, are mined via one or several shafts of a large diameter, which for this purpose are sunk down to the depth of the layers to be exploited.

Moreover, it is necessary to bore in horizontal or inclined direction a number of crosscuts and gateways that serve for the supply or transport of personnel and material, the transport of the substance mined and the supply of air, electricity and other provisions necessary for the progress of work.

Mining layers of mineral that are reached in this way can be effected i.a. with scraping or planing devices that can be moved to and fro mechanically or hydraulically.

This method has a number of drawbacks, the most important of which are that it is expensive and makes it necessary that the men do their work while for a long time being shut off from daylight in a less attractive and rather hazardous environment.

SUMMARY OF THE INVENTION

It is the object of the invention to provide a method and a system for mechanically mining underground minerals in such a way that it is no longer necessary for men to go underground via shafts of a large diameter to mine mineral there and to transport it via these shafts towards the surface. Therefore, according to the invention a sectional scraper structure, foldable into a zigzag position, is lowered through a bore hole into a mineral formation in a stretched condition and then brought into a folded condition with the aid of a pulling member, putting thereby scraping members in operational position and then being moved upwards and downwards by action from the upper side of the bore hole and the mineral scraped loose is brought upwards through the bore hole by means of liquid circulated through the bore hole.

GENERAL CONSIDERATIONS ON THE INVENTION

As this method involves that the mineral layer mined replaced by a liquid having the proper rheological properties, it will also be possible to prevent that — as in the customary method — the roof formation collapses, which may cause sinkings to occur at the surface.

Hereinafter, for the sake of simplicity, furthermore, reference will be made to coal layers only. By this all minerals are meant deposited in layers at such a depth that they cannot be exploited by means of open cast mining.

Though hereinafter only winning of solid state minerals is mentioned, the same method can also be applied in winning minerals by means of dissolving or suspending. In this case the scraping device to be described later can be equipped with so-called spraying nozzles instead of or together with scraping means then liquid can be circulated through the apparatus, such that a hydraulic jet action is exerted. Then the scraper structure will have to be connected with the supply means for the circulation of liquid.

The method consists in boring, and finishing with casings, a hole with a diameter customary in the oil industry. This hole is deviated such that at the location of the coal layer it penetrates into the layer such a small angle that the hole, furthermore, proceeds in this layer.

Such is promoted by the fact that the coal is much softer and brittler than the surrounding rock formations. It is desirable for the method that the coal layer makes an angle, though a small one, with the horizontal and that the bore hole penetrates the coal layer in downward direction, as much as possible in the direction of the dip of the formation.

The length of the stretch that is bored in the coal layer is variable and will, for instance, depend upon geological conditions, such as the presence of faults in the formation. So: in order to be able to deviate successfully bore holes in the coal layers, of course it is of importance that the geometry of the subsoil be known, e.g. geologically surveyed. In the hole over the coal layer provisions have to be made as they are applied in the oil industry, in order to make it possible, after mining the coal at the location of the first hole, to close this hole and then to deviate again from a higher point in the bore hole, to exploit the same coal layer at an other point or even to exploit an another coal layer (see FIG. 1, where this is schematically shown).

If a coal layer is exploited in several places successively, care should be taken that between the sections mined, sections still unexploited are left (room-and-pillar method), which will aid, besides the liquid pressure, in supporting the roof formations. If this would not be the case to an adequate extent, then by so-called formation fracturing the chambers might communicate, as a result of which the chambers might collapse prematurely.

Upon exploiting the coal layer according to the invention, after boring and finishing the hole, a sectional folding scraper structure is, in stretched condition, let into the hole, and folded out mechanically at the location of the coal layer and as a result folded laterally in such a way that knives, stratchers or other scraping means are pressed horizontally into the coal. Depending upon the particular construction of the scraper structure, the force of pressure of the scraping means will increase according to the extent of folding as a result of which it is possible that initially sufficient force cannot be exerted onto the knives. Special types of scraper structures may be devised for effecting the widening of the bore hole in which e.g. the action of the scraper structure is less dependent on the extent of unfolding.

Should it not be possible, however, to enlarge the bore hole in this way, then firstly it can be enlarged into a chamber by burning the coal, before scraping is started.

In order to enable this burning the liquid present should be removed with the aid of pressurized air by introducing a thin tube down the end of the coal layer in a way that is customary in the oil industry, whereupon a part of the coal layer is burnt away with the aid of circulating air.

In so doing, very high temperatures arise in consequence of which it is necessary to protect both the inner tube and the casing of the wall, for instance, by reducing the temperature by injecting water together with the air or via an extra second tube, which is simultaneously let down into the bore hole. The subject matter discussed is, for instance, approximately described in an article dealing with so-called "blind hole drilling" by Warner F. E. and entitled "underground gasification of coal II." Proceedings A.I.Ch.E.-Chem. Eng. joint meeting London 1965, Symposium no. pp 49–55.

After a chamber of sufficient diameter has been made this chamber may be filled with water or a somewhat heavier liquid. Later on, in case of a still larger chamber, one switches over to utilizing a heavy liquid. It is possible that this intermediate stage of water or of a somewhat heavier liquid can be omitted. The heavy liquid has a specific gravity higher that that of the coal to be mined, but not higher than the specific weight of the roof formation. The purpose of this liquid is threefold.

The pressure of it is high enough to prevent that the chamber in the coal collapses by action of the roof or floor layers. Preferably the pressure of it is low enough to promote cleavage of the coal.

It enables the circulation of the pieces of coal that are scraped loose through the chamber and then through the bore hole. Instead of circulating, floating upwards of the pieces of coal might also be possible in the chamber.

Through variation in the specific gravity, the liquid can ensure that the hollow closed sectional scraper will float against the roof formation or will be suspended, if necessary. In the first case the action of the scraper will not be hampered by lumps of rock that may sink towards the floor of the chamber and have a specific gravity which is still higher than that of the heavy liquid.

At the surface side of the bore hole coal is separated from the heavy liquid, for instance, by vibrating screens, whereupon this liquid can again be used for the same purpose. Since it is inherent to the method that it is possible to construct (a) scraper device(s) that can be let down through a borehole into the coal layer, here one possible construction of such a scraper device is explained by way of example. A scraper device that can be used to mine the coal comprises a hollow cylindrical connecting pipe extending throughout the bore hole, at the lower end of which pulling means such as a pulling cable has been attached. The lower part of this pipe, i.e. the part to be brought inside the coal layer is, for reasons that have already been explained, hollow, sectional and closed. The cable here runs at the outside of the sectional structure. In the lowermost part of the hollow connecting pipe forming the first closed section of the sectional scraper structure, one or more openings are provided, through which the pulling cable is guided in a sealed way inwardly and consequently is situated within the hollow connecting pipe further upward. Substantially just above these openings (this opening) the hollow cylinder through which the heavy liquid can be supplied, in most cases will be provided with circulation openings, so that circulating can be done as far as this depth, which generally spoken is where the bore hole emerges into the coal layer.

The hollow closed part of the cylinder is divided into sections which are attached to each other by means of hinge members. On, or near these hinged joints sideward directed scraping means such as knives or scratcher members are mounted. Of these hinge members various constructions are possible, among which is one such that the direction of the scraping means at all times points to the direction of the bisectrix of the angle between the cylinder sections. The scraping means can be constructed in many ways, too. At a few places the pulling cable is slidingly connected with the cylinder sections or with the hinge members between the sections to ensure that the hinges by turns fold to either side in zig-zag position. In practice such sliding connection is at every second hinge member. This lateral folding is effected by pulling at the surface side the pulling cable to tension in respect of the connecting pipe. In so doing, the scraping means are pressed into the coal.

Now by moving downwards and upwards the pulling cable and the connecting pipe together from above the surface the scraper structure will move to and fro in the coal face and thereby will not undercut the coal face (as is the case with prior art coal scrapers) but will overcut the coal face. In this way the cleaned coal in the subsurface will be freed and float upwards, since its specific weight is lower than that of the heavy liquid.

The scraper device should be constructed in such a way that in case of the downward stroke, the scraper will meet with a minimum of frictional resistance against the coal layer. Should the folded sections of the scraper structure in the downward part of the stroke become jammed in the coal, then this can be checked by easing off the pulling cable to a lesser or greater extent, thereby giving the scraper the opportunity to stretch itself, for instance, with the aid of springs provided for the purpose.

A tendency of the scraper structure to become jammed may also be reduced by providing so-called circulation nozzles at the location of the scraping means and providing means for connecting these nozzles to the liquid supply in the hollow cylinder. As a result of the circulation by these nozzles the scraper structure will have the tendency to stretch itself. It will be clear that such circulation nozzles may have been provided for other reasons, e.g. to improve the scraping action.

In that case the circulation openings adjacent to the first section of the scraper structure are omitted.

At the surface side of the bore hole, an "equal-tension-device," such as is known from the oil industry, is placed between the connecting pipe and pulling cable to maintain the force of the scraping means on the coal wall during the pulling strokes constant.

At the surface side of the bore hole moving upwards and downwards of the cylinder and pulling cable can be effected with appropriate mechanism known in this field of industry. It will be clear that so as to render circulation of liquid possible the pulling cable has to emerge at the surface side out of the hollow cylinder via a seal. The hollow cylinder must also at the surface have one or more feed openings for the circulation of liquid.

It will be clear that the number of sections and so the number of scraping means can vary according to wishes, the length of the sections determining how broad the chamber will finally become and how long the stroke of the scraper initially will have to be.

So as to promote cleavage of the coal formation during the process it may be desirable to vary the pressure and/or the specific weight of the circulating liquid, by means of which fluctuations may be effected in the rock stress in the coal layer and in the roof and floor formations.

It will be clear that as pulling means instead of a pulling cable, also a solid or a hollow pulling rod can be used to effect the pulling force required. Via such a hollow pulling rod circulation liquid can be supplied to the end of the scraping device, if such would be preferred.

BRIEF DESCRIPTION OF THE DRAWING

The invention will now be explained on the basis of an embodiment of the invention shown exclusively by way of example in the drawings, wherein FIG. 1 schematically shows some mineral layers under exploitation and the bore hole deviations required for this purpose, splitting off from a common main bore hole (as already explained above).

DESCRIPTION OF THE PREFERRED EMBODIMENTS

Figure 1:
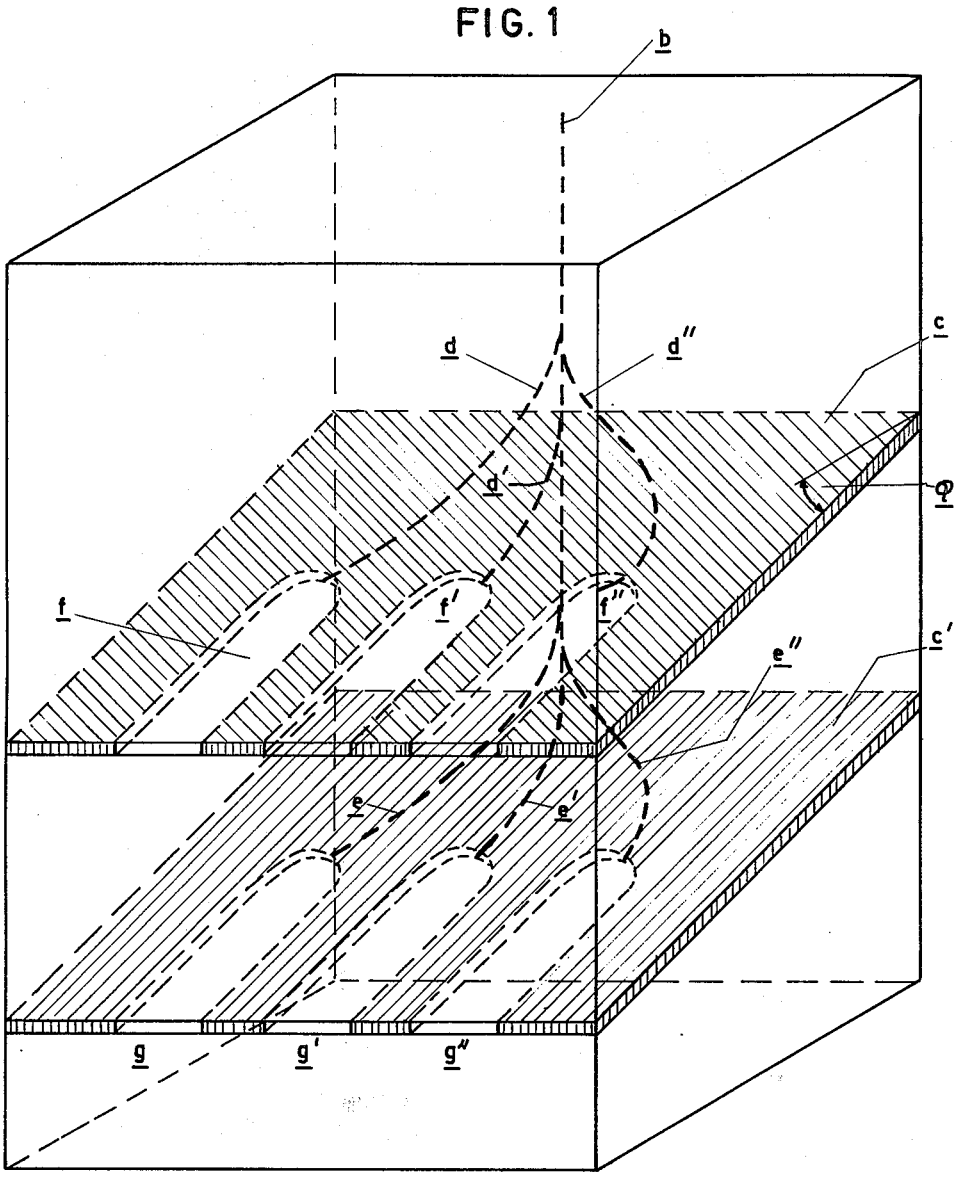

FIG. 1 shows schematically two coal layers *c* and *c'*, a bore hole *b* with deviating bore holes *d*, *d'* and *d''* leading into layer *c*, and deviating bore holes *e*, *e'* and *e''* leading into layer *c'*. At the end of the deviating bore hole chambers *f*, *f'*, *f''*, *g*, *g'* and *g''* have been made by means of a scraping device as described in this specification.

Figure 2:
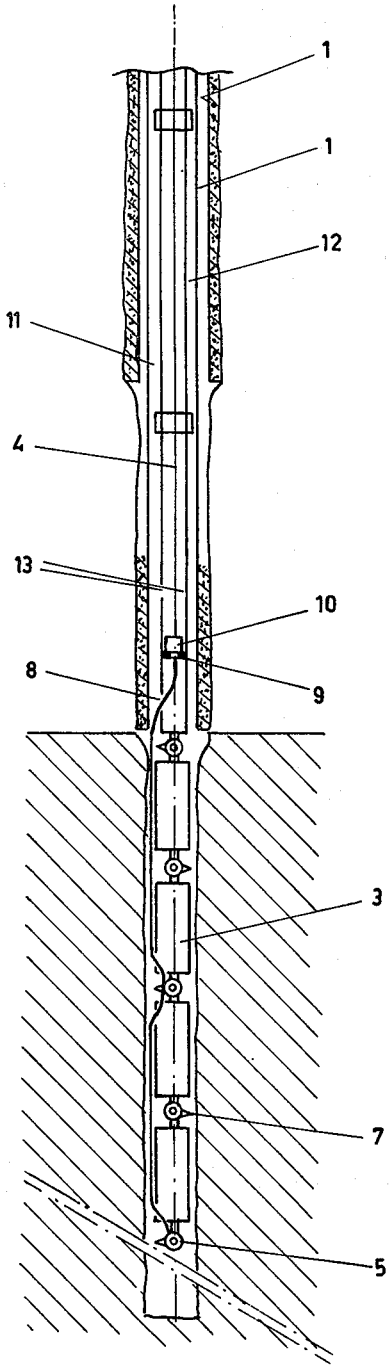
FIG. 2 is a side view and a partial upper view of a prepared bore hole, the lower part of which is not protected and runs through a coal layer. The mechanical scraper device is let down as far as the bottom but not brought into action yet.

After the bore hole has been bored and has been deviated in the coal layer in the way in FIG. 2 it is finished as far as the top of the coal layer with two series of steel casing strings 1.

Figure 5:
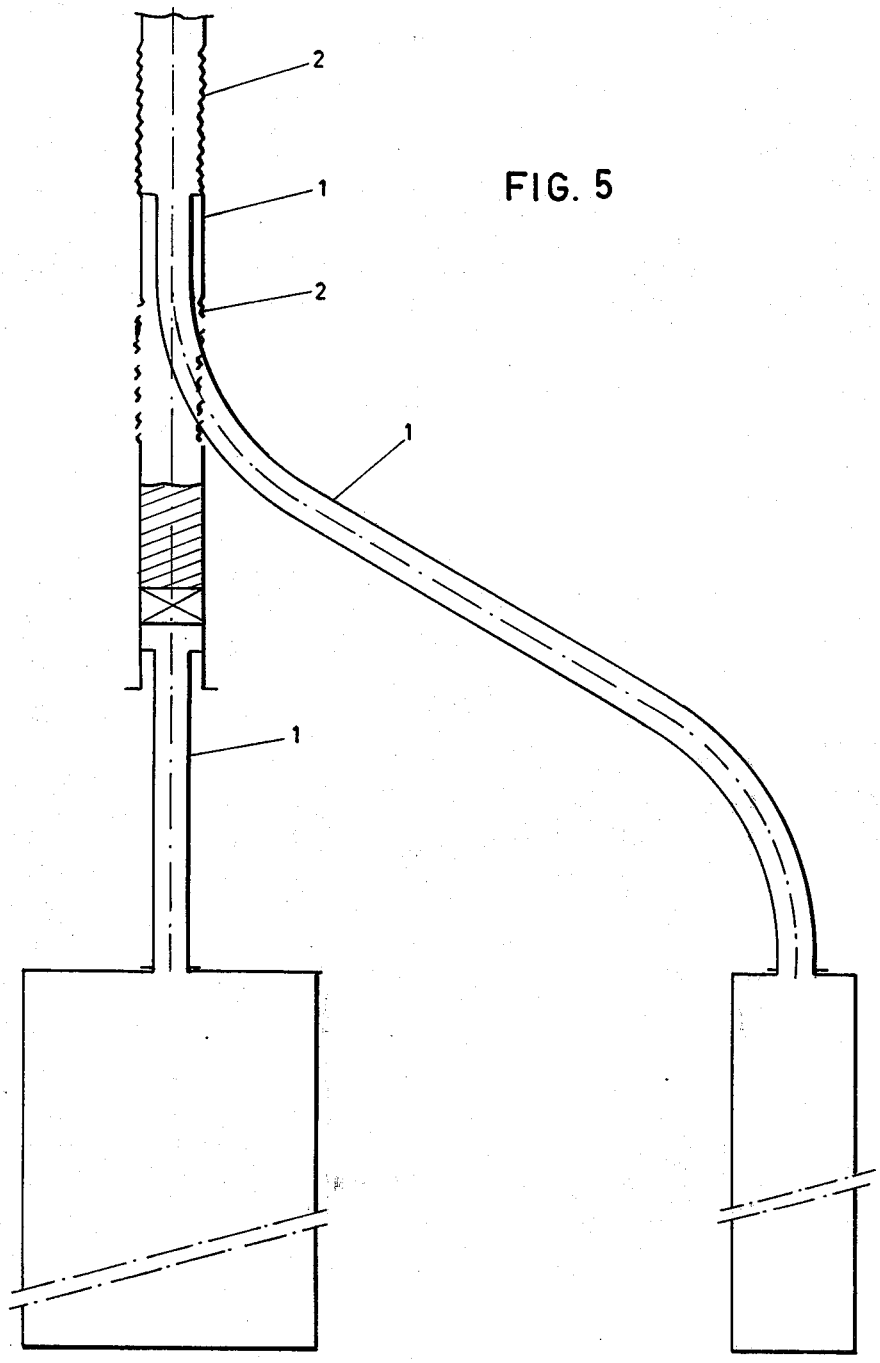
FIG. 5 shows an upper view of the situation after one bore hole has been exploited and plugged off and the exploitation of the same layer via a second bore hole is in the process of being carried out.

At various places in these casing strings, sections 2 (see FIG. 5) of other material e.g. "securaloy" can be inserted so as to make it easier later on to be able to deviate to other points in the same coal layer or other coal layers. The sections can be removed chemically or by means of milling. Without making use of the latter, one or more windows can be made in the casing strings, too, in order to use the upper part of the cased bore hole again. So as to show that a scraper structure that has been passed through the bore hole indeed can be unfolded laterally in the coal layer, one of the many constructions possible is further described here in brief.

Figure 4:
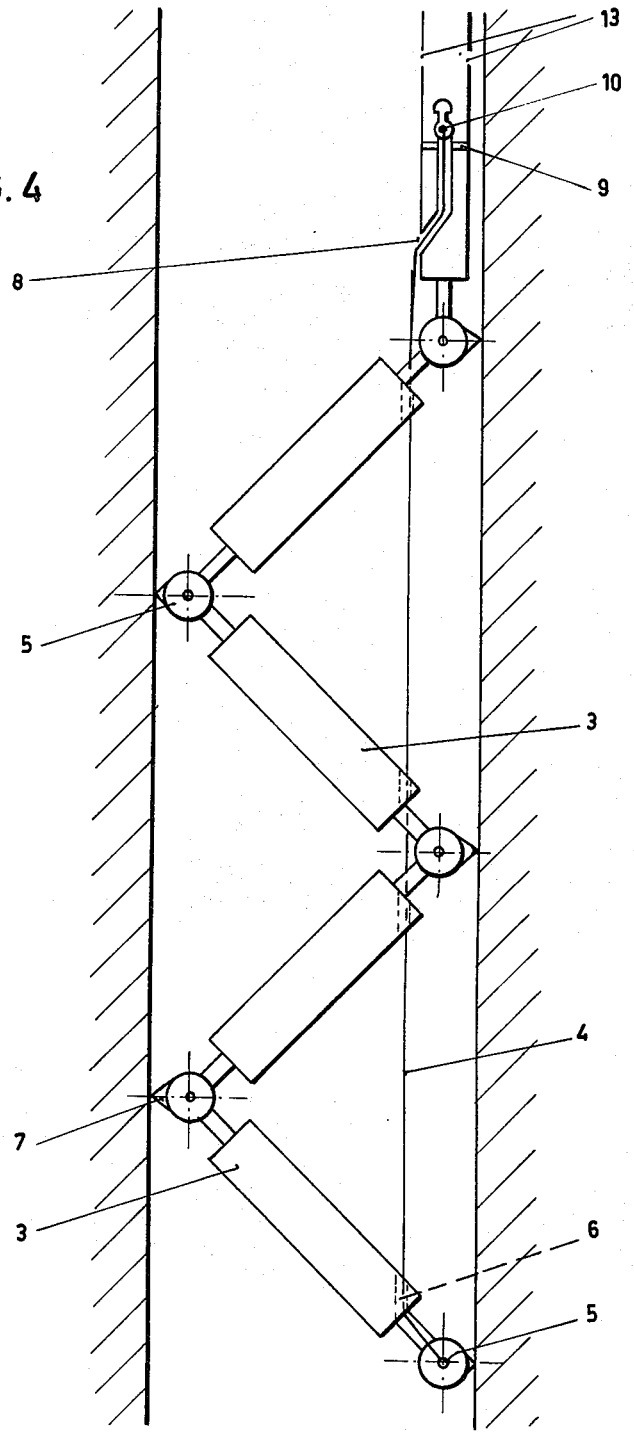
FIG. 4 is an upper view of a scraper operation, the coal layer being already partly removed.

In the case drawn (FIG. 4) the scraper structure consists of four sections, which are hingingly attached to each other. They are contracted by pulling cable 4, which is attached to the lower end of the scraper structure at 5, and furthermore guidingly attached to half of hinged joints 6, as can be seen in FIG. 4. The first section is formed by the underside of the pipe tube 12.

In order to promote the displacement of the scraper structure in the direction of the lower end of the bore hole, the hinges can be constructed springingly in such a way that the stretched condition is temperarily fixed by spring-loaded connections or snap connections. By pulling them cable 8 the scraper structure is folded up again.

It will be clear that the choice of the wall-thickness and inner diameter of the hollow closed sections is determinative as to whether the entire scraper structure will scrape in floating, sinking or suspended condition. If, for instance, a cut is made at the upper surface of the coal layer, the underlying coal will, hopefully, be cleaved by the action of the rock pressure, it will then start floating in lumps against the roof formation and either is having the opportunity to move to the entrance of the cased bore hole via the inclined chamber or it has to be moved towards said entrance mechanically or hydraulically.

FIG. 4 also shows that the length of the scraper at any moment depends upon its breadth, on the understanding that the apparatus shortens when it is folded further.

Consequently, primarily, it will not be necessary that the upper view of the chamber to be formed is rectangular. It may also be desirable to make use of several apparatuses with different folding reaches by exchanging them at the surface, so as to exploit the coal layer over its full breadth as well as to initiate the formation of the chamber out of the uncased bore hole in the coal layer.

The teeth, knives or other scraping means of scraper structure 3 can be constructed in many ways. Their length must be such, however, that they cannot hamper the passage of the scraper structure through the bore hole downwards when the sections are in stretched condition.

The scraper structure is connected with the surface by pipes screwed to each other, forming together the entire scraper device. These pipes have a diameter chosen such that a reasonable annular space remains for the coal recovery.

Figure 3:
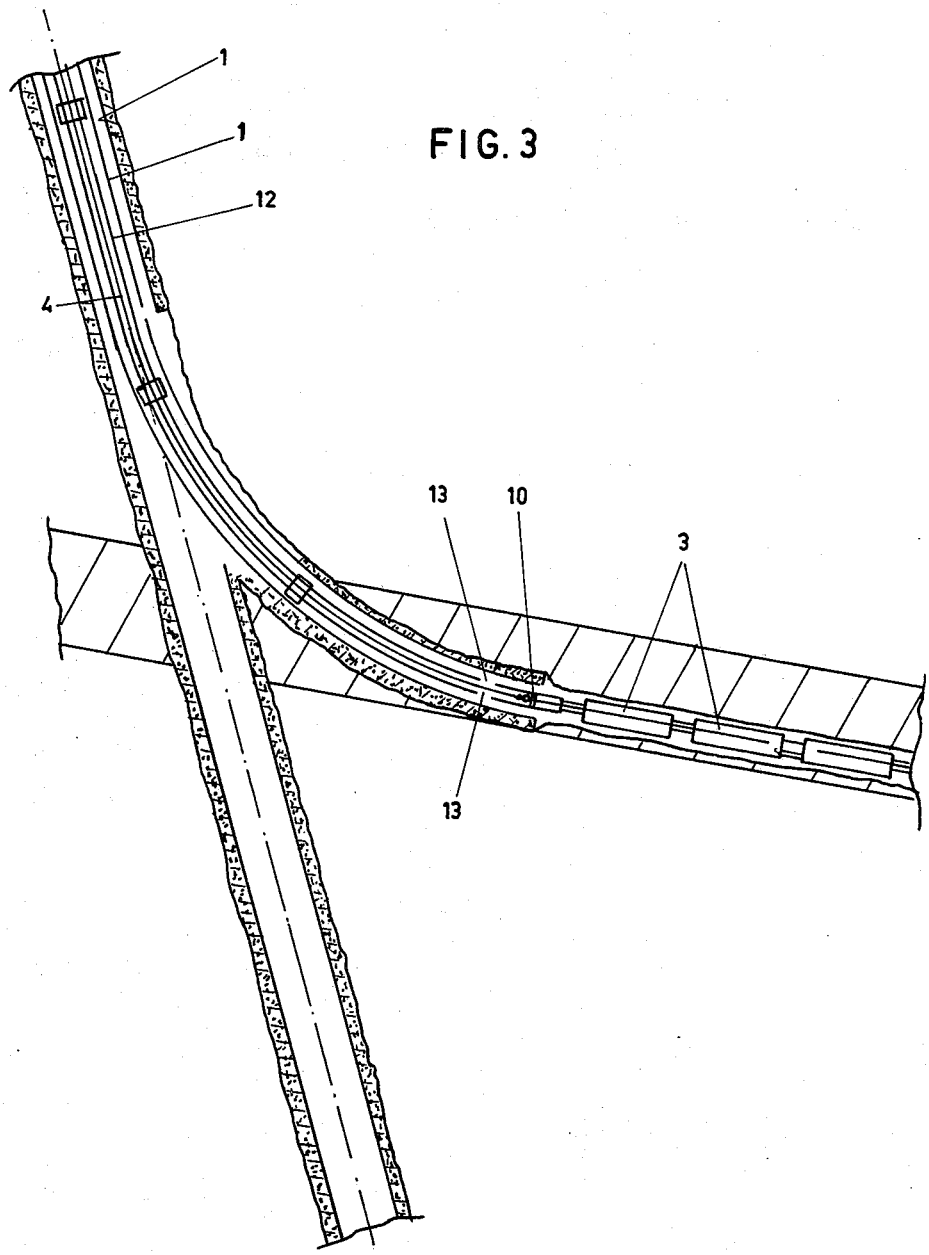
FIG. 3 is a side view from another plane of the system at right angles to that shown in FIG. 2.

The pulling cable emerges through opening 8 into the hollow connecting pipe right over the scraper structure, in consequence of which a buckling of the connecting tube is prevented under tension. It is not possible simultaneously to run in the pulling cable, while running in the scraper structure and connecting pipes for then this cable would be formed by a great number of loose sections connected to each other. As this is but little pratical, the following method is applied in the example: After the scraper structure itself, with the pulling cable attached to it at the outside, has been lowered into the bore hole, the pulling cable is guided into the upper scraping section at the underside of the hollow tube through opening 8, whereupon the upper end is guided through plate 9. On this extremity a retainer device 10 is attached of a size sufficiently great to bear on plate 9, so that the pulling cable cannot be pulled through retainer device 10. For the sake of simplicity device 10 is shown in FIG. 4 of the drawing as the end of the cable with scraper structure in folded position. It is self-evident that the length is such that when the scraper is in a stretched condition device 10 just bears on plate 9 as shown in FIG. 3. This retainer device is of such a construction that coming from above and operating from a distance, one can connect to it or disconnect from it an other cable or pull rod at will. After the scraper structure has been let in the bore hole, a cable with the appropriate catching device is then lowered whereupon the connection with the lower section of the cable is brought about.

FIG. 4 also shows the circulation holes 13 for circulating the liquid about. This liquid circulates down through the connecting pipes to somewhere near the scraper structure and together with the lumps of coal returns to the surface, via annular space 11. If the lumps are too large, they can be reduced to the correct size by the scraper or by other mechanical crushers. To this purpose perhaps the apparatus has to be exchanged now and then, involving some round tripping. The coal can be won at the surface by means of vibrating screens and other devices known per se from the ore benefitiation. It will probably be necessary to recondition the liquid from time to time by methods which are known in the field of mining and petroleum industry.

During the excavation as the chamber becomes larger the connecting pipes 12 at the surface will have to be lengthened. This may be done by temporarily stopping the activities and screwing together one or more joints of pipes 12 of, for instance, 10 meters length each. Close to the surface, the pulling cable may be replaced by pump rods and so-called "polished rod".

The latter passes through a stuffing box placed at the end of the connecting pipe 12; connecting pipe and polished rod via an equal tension device are both being suspended from a rotary hook and traveling block that provides for the upward and downward movement.

Circulating openings are present to circulate the heavy liquid into the connecting pipe.

The hoisting device that brings about this upward and downward movement is not drawn but can be a conventional hoisting device, such as is used in the oil industry.

We claim:

1. A method of mining minerals comprising forming a bore hole from the surface into the mineral formation, introducing into the bore hole from the surface in a stretched position a sectional scraper structure that can be folded into a zig-zag position in the mineral formation, pulling the scraper into a zig zagged condition from the surface, moving the zig zagged scraper up and down from the surface to exert a scraping action in the mineral formation and circulating a liquid through the bore hole to raise the scraped loose mineral upwardly through the bore hole.

2. The method of claim 1 wherein new holes are deviated at several depths in the bore hole of the same or other mineral layers.

3. The method of claim 1 wherein the circulating liquid is introduced by hydraulic jet at the location of the scraping means.

4. The method of claim 1 wherein the circulating liquid has a gravity which is not higher than the equivalence of the pressure of the roof formation.

5. The method of claim 4 wherein the specific weight of the circulating liquid is controlled to float, suspend or sink the scraper structure.

6. The method of claim 4 wherein the specific weight of the circulating liquid is adjusted so that the pressure of the remaining rock can cleave the mineral layer without substantially collapsing the roof formation.

7. The method of claim 4 wherein the liquid pressure is varied or oscillated to promote cleavage of the mineral.

8. The method of mining minerals comprising forming a bore hole from the surface into the mineral formation, introducing into the bore hole from the surface in a stretched position a sectional scraper structure that can be folded into a zig-zag position in the mineral formation, pulling the scraper into a zig zagged condition from the surface, moving the zig zagged scraper up and down from the surface to exert a scraping action in the mineral formation and circulating a liquid through the bore hole to raise the scraped loose mineral upwardly through the bore hole, replacing the circulating liquid in the chamber formed after completion of the mining with a liquid under pressure, sealing the said chamber under pressure so that the roof of the chamber is prevented substantially from collapsing during mining in adjacent chambers.

9. A scraping device for the underground mining of a mineral formation comprising a hollow cylindrical connecting pipe to be inserted into a bore hole, a closed hollow scraper means in a plurality of sections with adjacent sections being hinged so that the scraper may be folded into a zig-zag position, means for folding the scraper means in its zig-zag position from the surface, the scraper means sections being mounted so that when the scraper means is folded the scraping portions are extending sideways with respect to the central axis of the scraper means as a whole, the hollow connecting pipe means ending in a first closed section of the scraping means and means provided in the hollow connecting pipe for circulating liquid through the bore hole.

10. A scraping device for the underground mining of a mineral formation comprising a hollow cylindrical connecting pipe to be inserted into a bore hole, a closed hollow scraper means in a plurality of sections with adjacent sections being hinged so that the scraper may be folded into a zig-zag position, means for folding the scraper means in its zig-zag position from the surface, the scraper means sections being mounted so that when the scraper means is folded the scraping portions are extending sideways with respect to the central axis of the scraper means as a whole, the hollow connecting pipe means ending in a first closed section of the scraping means and means provided in the hollow connecting pipe for circulating liquid through the bore hole, the said means for folding the scraper means comprising pulling means passing from the surface through the hollow connecting pipers and being slideably connected to every second hinged sections and secured to the lower end of the lower most scraping section.

11. A scraping device as claimed in claim 9 wherein the connecting pipe just adjacent to the first section of the scraper structure, is provided with discharge openings for the circulation of the liquid.

12. A scraping device as claimed in claim 9, wherein the connection pipe just adjacent to the first section of the scraper members comprises spraying nozzles for circulating liquid to the scraper via the connecting pipe.

* * * * *